United States Patent [19]

Kusaka

[11] Patent Number: 4,501,233

[45] Date of Patent: Feb. 26, 1985

[54] HEAT RECOVERY STEAM GENERATOR

[75] Inventor: Iwao Kusaka, Kure, Japan

[73] Assignee: Babcock-Hitachi Kabushiki Kaisha, Tokyo, Japan

[21] Appl. No.: 487,820

[22] Filed: Apr. 22, 1983

[30] Foreign Application Priority Data

Apr. 24, 1982 [JP] Japan ..... 57-69229
Apr. 24, 1982 [JP] Japan ..... 57-69230

[51] Int. Cl.[3] ..... F22D 7/00

[52] U.S. Cl. ..... 122/406 S; 60/39.182; 122/7 R; 122/406 ST; 122/420

[58] Field of Search ..... 122/1 R, 7 R, 406 R, 122/406 S, 406 ST, 412, 414, 420, 421, 448 R, 466, 468, 470, 488; 60/39.182

[56] References Cited

U.S. PATENT DOCUMENTS

| | | | |
|---|---|---|---|
| 3,150,487 | 9/1964 | Mangan et al. | 60/39.182 |
| 3,508,526 | 4/1970 | Michel | 122/406 S |
| 3,769,795 | 11/1973 | Rostrom | 122/7 R |
| 4,205,633 | 6/1980 | Wittchow | 122/406 S |
| 4,207,842 | 6/1980 | Kehlhofer | 60/39.182 |

*Primary Examiner*—Edward G. Favors
*Assistant Examiner*—Steven E. Warner
*Attorney, Agent, or Firm*—Beall Law Offices

[57] ABSTRACT

Heat recovery boiler equipment comprising high and low pressure boiler drums and high and low pressure evaporators is disclosed. A recirculation pipeline system is also disclosed in which a control device is provided to control the flow rate of recirculated feed water to maintain a temperature below which cold corrosion occurs. The recirculation of feed water allows for a shorter starting time during restart. Additionally, pressure can be held at a predetermined value to prevent corrosion due to the intrusion of air.

13 Claims, 5 Drawing Figures

HEAT RECOVERY STEAM GENERATOR

BACKGROUND OF THE INVENTION

1. Field of the Invention

The present invention relates to heat recovery steam generators, and more particularly to a heat recovery boiler equipment provided with a low pressure evaporator and a high pressure evaporator.

2. Description of the Prior Art

The conventional heat recovery boiler of the type described comprises: for example, a high pressure boiler system including a high pressure super heater, a high pressure evaporator, a high pressure economizer and a high pressure boiler drum; a low pressure boiler system including a low pressure evaporator, a low pressure economizer and a low pressure boiler drum; and a water feed system for feeding water to the low pressure and the high pressure boiler drums, respectively, through the economizers in both the boiler systems. The above-mentioned high pressure super heater, high pressure evaporator and high pressure economizer as well as the low pressure evaporator and low pressure economizer are arranged in an exhaust gas flow path of a gas turbine in the described order for example, whereby waste heat contained in the exhaust gas is recovered to generate steam.

In the equipment as described above, at the time of start up of a gas turbine plant or a boiler, since the gas temperature is low for the high flow rate of the exhaust gas, heat recovery is mainly conducted in the low pressure evaporator and low pressure economizer, whereby, particularly, the temperature of feed water passing through the low pressure economizer is elevated and becomes higher than the saturation temperature of water corresponding to the internal pressure of the low pressure boiler drum to which the water is fed. As a result, water-steam mixture is formed, and when it is introduced into the drum, such a disadvantage is presented that steam is mixed into a down comer of the drum, thus normal circulation of the water is blocked resulting in burning damages to boiler tubes. Further, since water fed to the drum contains a considerable amount of steam, a product steam separated from the drum is mixed with mist, thus lowering the efficiency of separating water from steam in the drum. Further, in the case where evaporation occurs in the low pressure economizer, there occurs such a phenomenon that flowing in the water becomes so unstable as to give water hammering or the like in the economizer tubes, which is dangerous as it damages boiler equipment. In order to prevent water from steaming in the economizer, a pipe line is provided which circulates water from a water feed inlet of a low pressure drum or a high pressure drum to a condenser or a deaerater, thereby increasing the feed water flow rate to the economizer. However, with these methods, such a disadvantage is presented that the installation cost and operating cost are increased.

SUMMARY OF THE INVENTION

The present invention has been developed to obviate the above-described disadvantages of the prior art and has as its object the provision of a heat recovery boiler capable of easily controlling temperature and pressure of feed water to an economizer and a boiler drum at low installation and operating costs, making a drum level stable and inhibiting the aforesaid steaming or evaporation in the economizer.

Another object of the present invention is to provide a heat recovery boiler capable of preventing corrosion of associated components, which is generated when deaeration of water fed to a low pressure economizer is conducted through condensate deaeration by use of a condenser without using a deaerater.

A further object of the present invention is to provide a heat recovery boiler capable of preventing corrosion of the drum and associated components, which is generated by the intrusion of external air due to decreased internal pressure in a low pressure boiler drum at the time of temporary stop of the boiler in operation such as hot banking.

According to the present invention, in a heat recovery boiler equipment comprising: a high pressure boiler drum and a low pressure boiler drum connected to a high pressure evaporator and a low pressure 00 evaporator, respectively; and pipelines for feeding water to the aforesaid drums through a low pressure economizer and a high pressure economizer, respectively; a pipeline is provided which feeds a part of feed water from an outlet of the low pressure economizer to the high pressure economizer through a pump, and a flow control valve is provided on a pipeline leading to an inlet of the low pressure boiler drum in order to prevent steaming from occuring in the low pressure economizer, as well as controlling the flow rate of water fed to the lower pressure boiler drum. Between the high pressure economizer and the high pressure boiler drum can also be provided a flow control valve for preventing steaming from occuring in the high pressure economizer as well as controlling the flow rate of water fed to the high pressure boiler drum.

It is desirable that, in the aforesaid pipeline system, the pipeline leading to the high pressure economizer be branched and one of the pipelines thus branched is connected to the pipeline leading to the inlet of the low pressure economizer, whereby a recirculation pipeline system is formed, and a flow control valve is provided on the aforesaid recirculation pipeline system.

Furthermore, it is desirable that a temperature detector be provided on the pipeline leading to the inlet of the low pressure economizer, and a flow control device is provided which controls the flow control valve of the recirculation pipeline so that the temperature detected by the aforesaid temperature detector may remain within a predetermined range.

Further, it is desirable that a connecting pipeline for steam be provided between the high pressure boiler drum and the low pressure boiler drum for sending high pressure steam to the low pressure boiler drum through the aforesaid connecting pipeline when steam pressure in the low pressure boiler drum becomes lower than a predetermined value, so that the aforesaid pressure can be held at the predetermined value or thereabove.

The high pressure evaporator, low pressure evaporator, high pressure boiler drum, low pressure boiler drum, high pressure economizer and low pressure economizer used in the present invention may be those normally used in manufacture of the boilers.

DETAILED DESCRIPTION OF THE INVENTION

Figure 1:
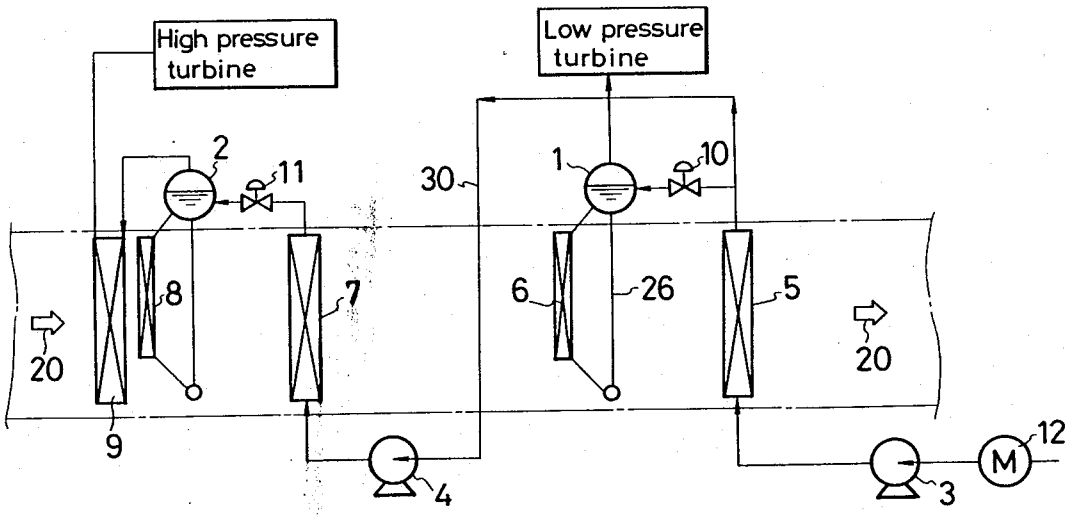
FIG. 1 is an explanatory view showing the components and pipeline system of the heat recovery boiler equipment of the present invention provided in an exhaust gas flow path of a gas turbine plant.

As shown in FIG. 1, the heat recovery boiler equipment comprises: a low pressure boiler system including a low pressure boiler drum 1, a low pressure economizer 5 and a low pressure evaporator 6; a high pressure boiler system including a high pressure boiler drum 2, a high pressure economizer 7, a high pressure evaporator 8 and a high pressure super heater 9; a low pressure water feed system for feeding water from a condenser 12 to a low pressure boiler drum 1 through the low pressure economizer 5 and a flow control valve 10 by means of a low pressure pump 3; and a high pressure water feed system for taking a part of feed water out, boosting the same in pressure by a pump 4 and feeding the same to the high pressure boiler drum 2 through the high pressure economizer 7 and a high pressure flow control valve 11. Exhaust gas 20 from a gas turbine, which temperature is 530° C., for example, is successively introduced to the aforesaid high pressure boiler system and low pressure boiler system, whereby high pressure steam and low pressure steam are generated, respectively. The steam is sent from the high pressure drum 2 to the high pressure super heater 9, where the steam is super-heated into high pressure steam, and the high pressure steam thus produced is sent to a high pressure steam turbine, where the high pressure steam rotates a steam turbine generator. On the other hand, steam generated in the low pressure boiler drum 1 is directly sent to a low pressure steam turbine.

The water which has been deaerated by the condenser 12, is boosted to an operating pressure (e.g., 9 atmg) by the low pressure pump 3, thereafter, enters a low pressure economizer 5, whence a part of water is introduced into the low pressure boiler drum 1 through the flow control valve 10 and the remaining part passes through a pipeline 30 and is boosted to 65–100 atmg for example, to be turned into high pressure feed water. In the case of start up of a gas turbine, where the exhaust gas 20 is comparatively low in temperature and high in flow rate, an amount of heat exchange is so increased in the low pressure economizer and the high pressure economizer that steaming in said economizer is liable to occur. In this case, the flow control valve 10 and/or 11 should be throttled down so that the pressure in the economizer may be maintained at more than the value of a saturated steam pressure in the economizer, thus steaming or evaporation in the economizer is suppressed, thereby making water flow in the economizer stable, while the rest of heated feed water is fed to the high pressure water feed system through the pipeline 30, thereby enabling recovery of the heat effectively.

Figure 2:
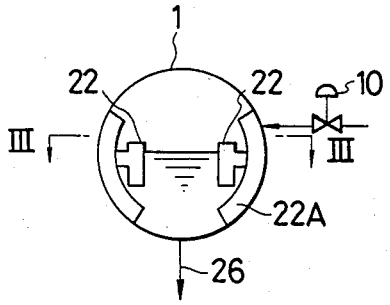
FIG. 2 is an explanatory view showing a section of the boiler drum when cyclone separators for gas-liquid separation are provided in the low pressure boiler drum.
Figure 3:
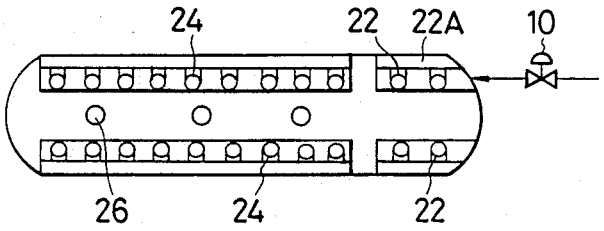
FIG. 3 is an explanatory view showing a section as viewed in the direction indicated by the arrows from line III—III in FIG. 2.

In FIG. 1, in addition to the control of the feed water flow control valve 10 (or 11), the provision of steam separators in a feed water pipeline leading to the inlet of the boiler drum 1 (or 2) makes it possible to sufficiently separate steam from the feed water. FIGS. 2 and 3 show an embodiment where cyclone steam separators 22 are provided at the feed water inlet of the economizer in the low pressure boiler drum 1. The high pressure boiler drum can also be provided with the same type of cyclone steam separator as the above. These cyclone separators 22 are arranged inside the boiler drum and are mounted against apertures in the inner wall of an annular compartment 22A, which is closed off from the water in the drum. Designated at 24 are cyclone separators formed in riser tubes from the low pressure evaporator 6, and at 26, a down-comer to the low pressure evaporator 6. The water or the water steam mixture, which has passed the flow control valve 10 and entered the low pressure boiler drum, enters the steam cyclones tangentially. The water whirls around the cylinder, forming a strong vortex which provides a separating force. The steam collects in the center and passes out of the top, where the corrugated scrubber plates effect the final removal of moisture from the steam, so that the steaming or the flashing and the mixing in of steam to the down-comer 26 can be prevented.

Figure 4:
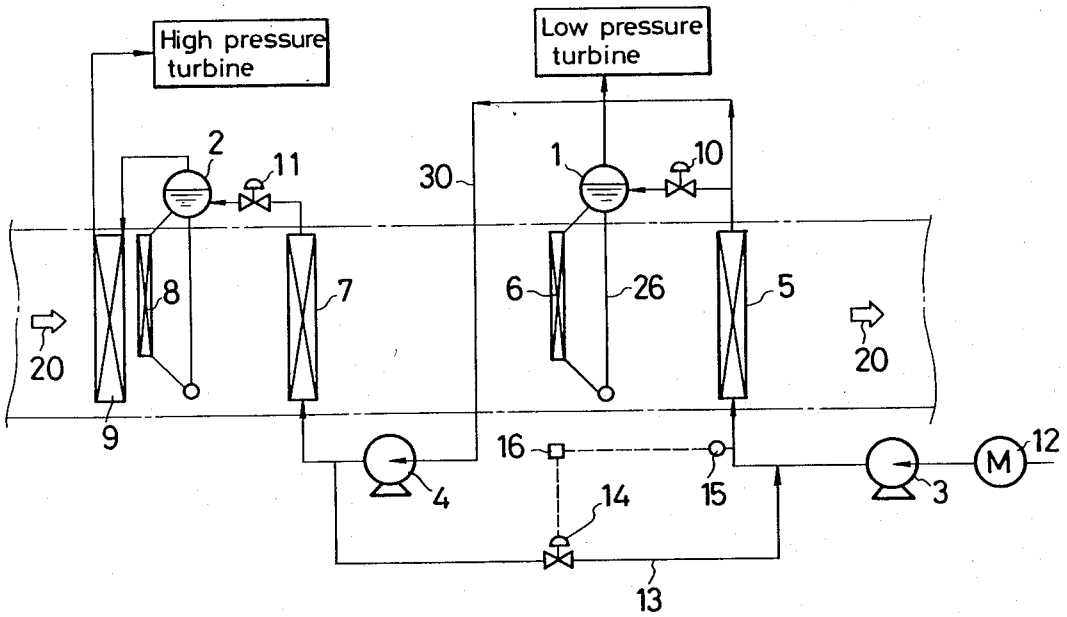
FIG. 4 is an explanatory view similar to FIG. 1, in which a further recirculation pipeline system is provided on the equipment shown in FIG. 1.

FIG. 4 shows heat recovery boiler equipment wherein, in addition to the equipment illustrated in FIG. 3, a feed water recirculation pipeline 13 is provided from the high pressure water feed pipeline system to the low pressure water feed pipeline system, and further, a flow control valve 14 for controlling the flow rate of feed water flowing through the aforesaid recirculation pipeline, so that the temperature at the inlet of the low pressure economizer 5 may remain within a predetermined range. Denoted at 15 is a temperature detector for detecting the temperature of feed water at the inlet of the low pressure economizer, and at 16 a temperature control device. During the start of the boiler, the temperature of feed water at the inlet of the low pressure economizer 5 is detected by the temperature detector 15, the opening degree of the flow control valve 14 in the recirculation flow path 13 is controlled by the temperature control device 16, so that the temperature of feed water at the inlet of the low pressure economizer 5 can be controlled above the critical temperature (e.g., a condensation temperature of acid material, 48° C., in the case of a gas fuel), and preferably 50°–70° C. below which the components and the like tend to suffer from cold corrosion, and a part of the high pressure feed water being high in temperature is recirculated.

As described above, a part of the high temperature feed water at the inlet of the high pressure economizer 7 is recirculated to the inlet of the low pressure economizer 5, whereby the temperature of feed water at the inlet of the low pressure economizer 5 is heated to a temperature where no cold corrosion occurs, so that the economizer 5 and the components disposed therearound can be prevented from being corroded due to some acid content in the exhaust gas 20, for example, acid ammonium sulfate etc., in the case where the boiler plant is accompanied with a denitrification plant. In the above embodiment, even if the high pressure boiler system is stopped in operation, the high pressure pump 4 is constantly in the operating condition and, the starting time of the high pressure boiler system can be advantageously shortened. Needless to say, in FIG. 4, only if the feed water of the high pressure boiler system is circulated through the low pressure boiler system, with no temperature control device 16 being provided, can the starting time of the high pressure boiler system be shortened.

Figure 5:
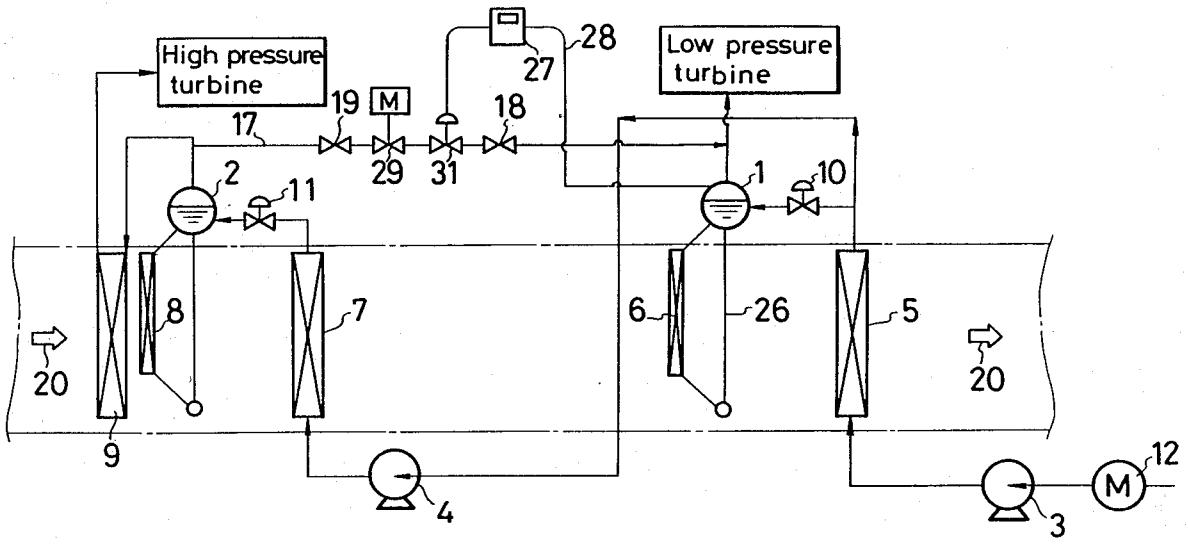
FIG. 5 is an explanatory view similar to FIG. 1, in which a further connecting pipeline for steam is provided between the low pressure boiler drum and the high pressure boiler drum.

FIG. 5 shows a heat recovery boiler equipment wherein, in addition to the equipment as illustrated in FIG. 1, the low pressure boiler drum 1 and the high pressure boiler drum 2 are connected to each other through a connecting pipeline 17. At the time of stopping operation of the gas turbine, dampers at the inlet and outlet of the exhaust gas flow path 20 are fully closed to hold the remaining heat of the boiler in the hot banking conditions. However, the pressure in the high pressure boiler drum is lowered due to natural cooling from 62 atmg during operation to about 15 atmg at the time of restart eight to ten hours after the stop in operation, for example. Because of this, in the case of starting by use of the steam in the same boiler for starting a plant, when the remaining pressure in the drum is low, the starting takes a long time so that the characteristic feature of a combined plant, such as a short starting time, cannot be fully displayed. On the other hand, since the operating pressure of the low pressure boiler drum 1 is 6 atmg, the pressure is lowered to 1.5 atmg or less during hot banking of 8–10 hours. When the pressure in the boiler drum is lower than atmospheric pressure, air is sucked from atmosphere through the various detecting devices, valves, etc., of the low pressure boiler system, the oxygen content in the drum water is being increased, and corrosion troubles occur not only in the low pressure boiler system but also in the high pressure boiler system. Further, in order to avoid the collapse of the drum due to a negative pressure, it is necessary to open a purge valve of the low pressure boiler drum when the pressure is as low as 1.5 atmg. However, when the purge valve is opened, air is sucked from the atmosphere through the purge valve, whereby corrosion to the low pressure boiler drum and an evaporation pipe occurs.

Because of this, in the equipment shown in FIG. 5, when the pressure of the low pressure boiler drum is lowered to a predetermined value or less, for example, 1.5 atmg or less during the aforesaid hot banking, the high pressure steam is introduced from the high pressure boiler drum 2 to the low pressure boiler drum 1 through the connecting pipeline 17 to hold the pressure of the low pressure boiler drum 1 at a predetermined value or thereabove, thereby obviating the aforesaid disadvantages. In FIG. 5, a valve 19, a heated steam stop valve 29, a heated steam pressure control valve 31 and a valve 18 are successively provided on the connecting pipeline 17. Further, the connecting pipeline 17 is provided thereon with a heated steam pressure detecting line 28 of the low pressure boiler drum for connecting the low pressure boiler drum 1 to the aforesaid pressure control valve 31 and a pressure regulating gauge 27.

In the above arrangement, when the plant is stopped in operation, the remaining heat of the boiler is held in the hot banking conditions as described above. At this time, when the pressure of the low pressure boiler drum 1 is lowered by natural cooling to 1.5 atmg or less for example, the internal pressure of the low pressure boiler drum 1 is detected by a pressure detecting line 28, the opening degree of the pressure control valve 31 is controlled in response to a signal from a pressure regulating gauge 27, and a suitable quantity of high pressure steam from the high pressure boiler drum 2 is introduced into the low pressure boiler drum 1 through the valve 19, the heated steam stop valve 29 and the valve 31, whereby the internal pressure in the drum 1 is held at 1.5 atmg or thereabove. The aforesaid heated steam stop valve 29 is an electrically-driven valve having an interlock mechanism which is fully closed during normal operating conditions and is opened when the water feed pumps 3 and 4 are stopped in operation, and the pressure of the low pressure boiler drum 1 is lowered to a predetermined value or less.

In the above embodiment, the steam is fed to the lower pressure boiler drum 1 from the high pressure boiler drum 2 during the hot banking of the boiler. Thus, the internal pressure of the lower pressure boiler drum 1 is held at a predetermined value (1.5 atmg or therebove in this case), so that the air leakage into the systems from atmosphere due to the lowered pressure of the boiler drum can be avoided, thus preventing corrosion in the systems. Additionally, since the pressure of the low pressure boiler drum is not lowered to the predetermined value or less during the hot banking, the starting time of the combined plant can be shortened.

The present invention can provide steam generating equipment particularly useful for the combined plant being high in thermal efficiency, wherein a gas turbine and a steam turbine are combined together and rotate electric generators, respectively, to generate high pressure steam and low pressure steam. However, the invention need not necessarily be limited to this, but, is applicable to any steam generating equipment having a high pressure evaporator and a low pressure evaporator.

What is claimed is:

1. A heat recover boiler equipment, comprising:

a high pressure boiler drum and a high pressure evaporator operatively connected together;

a low pressure boiler drum and a low pressure evaporator operatively connected together;

a low pressure economizer and a high pressure economizer;

a first pipeline operatively extending between the outlet of said low pressure economizer and the inlet of said low pressure drum;

a second pipeline extending between the outlet of said low pressure economizer and the inlet of said high pressure economizer, and bypassing said low pressure boiler drum;

a source of feed water;

pump means for receiving water from said source of feed water and pumping the water through said low pressure economizer and into each of said first and second pipelines;

valve means in said first pipeline for controlling the flow of water into said low pressure boiler drum;

second pump means in said second pipeline for pumping the water in said second pipeline that is downstream from said first pipeline into the inlet of said high pressure economizer;

a third pipeline operatively extending between the outlet of said high pressure economizer and the inlet of said high pressure boiler drum; and valve means in said third pipelines leading to the inlet of said high pressure boiler drum for providing flow control into said high pressure boiler drum from said third pipeline.

2. A heat recovery boiler equipment as set forth in claim 1, including:

a recirculation pipeline operatively connected from the inlet of said high pressure economizer to the inlet of said low pressure economizer; and a flow control valve in said recirculation pipeline.

3. A heat recovery boiler equipment as set forth in claim 1, including cyclone separator means for separating steam from water and being provided in said first and third pipelines leading to said low pressure and high pressure boiler drums.

4. A heat recovery boiler equipment as set forth in claim 3, wherein said cyclone separators are provided in the low pressure and high pressure boiler drums.

5. A heat recovery boiler equipment, comprising:

a high pressure boiler drum and a high pressure evaporator operatively connected together;

a low pressure boiler drum and a low pressure evaporator operatively connected together;

a low pressure economizer and a high pressure economizer;

a first pipeline operatively extending between the outlet of said low pressure economizer and the inlet of said low pressure drum;

a second pipeline extending between the outlet of said low pressure economizer and the inlet of said high pressure economizer, and bypassing said low pressure boiler drum;

a source of feed water;

pump means for receiving water from said source of feed water and pumping the water through said low pressure economizer and into each of said first and second pipelines;

valve means in at least one of said pipelines for controlling the relative flow of water in said pipelines;

second pump means in said second pipeline for pumping the water in said second pipeline that is downstream from said first pipeline into the inlet of said high pressure economizer;

a third pipelines operatively extending between the outlet of said high pressure economizer and the inlet of said high pressure boiler drum;

a recirculation pipeline operatively connected from the inlet of said high pressure economizer to the inlet of said low pressure economizer; and a flow control valve provided in said recirculation pipeline.

6. A heat recovery boiler equipment as set forth in claim 5, including temperature detector means for detecting the temperature of the water leading to the inlet of said low pressure economizer, and flow control means for controlling the flow control valve of said recirculation pipeline so that the temperature detected by said temperature detector means may be controlled within a predetermined range.

7. A heat recovery boiler equipment as set forth in claim 6, wherein said flow control means provide the predetermined range of temperature to be higher than the temperature causing cold corrosion in the equipment.

8. A heat recovery boiler equipment, comprising:

a high pressure boiler drum and a high pressure evaporator operatively connected together;

a low pressure boiler drum and a low pressure evaporator operatively connected together;

a low pressure economizer and a high pressure economizer;

a first pipeline operatively extending between the outlet of said low pressure economizer and the inlet of said low pressure drum;

a second pipeline extending between the outlet of said low pressure economizer and the inlet of said high pressure economizer, and bypassing said low pressure boiler drum;

a source of feed water;

pump means for receiving water from said source of feed water and pumping the water through said low pressure economizer and into each of said first and second pipelines;

valve means in at least one of said pipelines for controlling the relative flow of water in said pipelines;

second pump means in said second pipeline for pumping the water in said second pipeline that is downstream from said first pipeline into the inlet of said high pressure economizer;

a third pipeline operatively extending between the outlet of said high pressure economizer and the inlet of said high pressure boiler drum;

a connecting pipeline for steam provided between said high pressure boiler drum and said low pressure boiler drum; and means for determining when steam pressure in said low pressure boiler drum is lowered to a predetermined value or less, to thereafter send high pressure steam to said low pressure boiler drum through said connecting pipeline, so that pressure in said low pressure boiler drum is held at the predetermined value or thereabove.

9. A heat recovery boiler equipment, comprising:

a low pressure economizer;

means for pumping feed water into said low pressure economizer;

a low pressure boiler drum and a low pressure evaporator operatively connected together;

a high pressure economizer;

a high pressure boiler drum and high pressure evaporator operatively connected together;

a pipeline for passing water from the outlet of said high pressure economizer to the inlet of said high pressure boiler drum;

pipeline means for receiving water from the outlet of said low pressure economizer and feeding it to the inlet of said low pressure boiler drum and the inlet of said high pressure economizer, and including pump means for increasing the pressure of the water between said low pressure boiler drum and said high pressure economizer;

a recirculation pipeline operatively connected from the inlet of said high pressure economizer to the inlet of said low pressure economizer; and a flow control valve provided in said recirculation pipeline.

10. A heat recovery boiler equipment as set forth in claim 9, including temperature detector means for detecting the temperature of the water leading to the inlet of said low pressure economizer, and flow control means for controlling the flow control valve of said recirculation pipeline so that the temperature detected by said temperature detector means may be controlled within a predetermined range.

11. A heat recovery boiler equipment as set forth in claim 10, wherein said flow control means provide the predetermined range of temperature to be higher than the temperature causing cold corrosion in the equipment.

12. A heat recovery boiler equipment, comprising:

a low pressure economizer;

means for pumping feed water into said low pressure economizer;

a low pressure boiler drum and a low pressure evaporator operatively connected together;

a high pressure economizer;

a high pressure boiler drum and high pressure evaporator operatively connected together;

a pipeline for passing water from the outlet of said high pressure economizer to the inlet of said high pressure boiler drum;

pipeline means for receiving water from the outlet of said low pressure economizer and feeding it to the inlet of said low pressure boiler drum and the inlet of said high pressure economizer, and including pump means for increasing the pressure of the water between said low pressure boiler drum and said high pressure economizer;

a connecting pipeline for steam provided between said high pressure boiler drum and said low pressure boiler drum; and means for determining when steam pressure in said low pressure boiler drum is lowered to a predetermined value or less, to thereafter send high pressure steam to said low pressure boiler drum through said connecting pipeline, so that pressure in said low pressure boiler drum is held at the predetermined value or thereabove.

13. A heat recovery boiler equipment, comprising:

a low pressure economizer;

means for pumping feed water into said low pressure economizer;

a low pressure boiler drum and a low pressure evaporator operatively connected together;

a high pressure economizer;

a high pressure boiler drum and high pressure evaporator operatively connected together;

a pipeline for passing water from the outlet of said high pressure economizer to the inlet of said high pressure boiler drum;

pipeline means for receiving water from the outlet of said low pressure economizer and feeding it to the inlet of said low pressure boiler drum and the inlet of said high pressure economizer, and including pump means for increasing the pressure of the water between said low pressure boiler drum and said high pressure economizer;

high pressure cyclone separator means for separating steam from water and being provided inside of said high pressure boiler drum at its inlet;

low pressure cyclone separator means for separating steam from water and being provided inside of said low pressure boiler drum at its inlet; and each of said high and low pressure cyclone separators includes two separate cyclone separator portions, each portion having a compartment closed off from the water in its drum connected to receive the drum inlet water/steam and associated evaporator water/steam, respectively, and a centrifugal separator with an inlet connected to said compartment, a steam outlet connected to the steam area of its drum and a water outlet connected to the water area of its drum;

a separate downcomer pipe connected between the water area of each boiler drum and its associated evaporator; and said cyclone separator portions being spaced from each other and said downcomer pipe in each of said drums.

* * * * *